United States Patent [19]

Watanabe et al.

[11] Patent Number: 4,586,877

[45] Date of Patent: May 6, 1986

[54] ELECTRIC FUEL PUMP DEVICE

[75] Inventors: Kiyohiko Watanabe, Chiryu; Yoshiyuki Hattori, Toyoake; Kazuma Matsui, Toyohashi; Toshihiro Takei, Kariya; Toshiaki Nakamura, Anjo; Syunsaku Ohnishi, Toyota, all of Japan

[73] Assignee: Nippondenso Co., Ltd., Kariya, Japan

[21] Appl. No.: 692,867

[22] Filed: Jan. 18, 1985

Related U.S. Application Data

[63] Continuation of Ser. No. 405,579, Aug. 5, 1982, abandoned.

[30] Foreign Application Priority Data

Aug. 11, 1981 [JP] Japan ..... 56-125454

[51] Int. Cl.[4] ..... F04B 17/00; F01D 3/00

[52] U.S. Cl. ..... 417/365; 417/366; 417/423 R; 415/213 T; 415/106

[58] Field of Search ..... 417/365, 366, 372, 371, 417/423 R, 410; 415/53 T, 213 T, 198.2, 104, 106

[56] References Cited

U.S. PATENT DOCUMENTS

| | | | |
|---|---|---|---|
| 634,840 | 10/1899 | Warring | 415/104 X |
| 1,768,242 | 6/1930 | Ferguson | 415/213 T |
| 2,282,569 | 5/1942 | Fabig | 415/53 T |
| 2,554,536 | 5/1951 | Miller | 415/106 X |
| 3,259,072 | 7/1966 | Carpenter | 415/198.2 |
| 3,658,444 | 4/1972 | Rhodes et al. | 417/423 R |
| 3,891,355 | 6/1975 | Hecht et al. | 417/371 |
| 3,960,468 | 6/1976 | Boarse et al. | 415/104 X |
| 4,451,213 | 5/1984 | Takei et al. | 415/106 X |

FOREIGN PATENT DOCUMENTS

| | | | |
|---|---|---|---|
| 4324483 | 2/1965 | Japan | 415/53 T |

*Primary Examiner*—Carlton R. Croyle
*Assistant Examiner*—Theodore W. Olds
*Attorney, Agent, or Firm*—Cushman, Darby & Cushman

[57] ABSTRACT

An electric fuel pump for pumping a liquid fuel from a tank to an engine. The pump device has a regenerative pump section and an electric motor section for driving the regenerative pump section. The regenerative pump section includes a pump casing having a first inner surface and a second inner surface axially opposing to and spaced from each other to define therebetween a pump chamber, a shaft adapted to be rotatingly driven by the electric motor section and an impeller accommodated by the pump chamber and mounted on the shaft for rotation therewith but axially movably relatively thereto. The impeller has one axial end surface opposing to the first inner surface with a first gap formed therebetween, and the other axial end surface opposing to the second inner surface of the pump casing with a second gap formed therebetween. The first inner surface and the second inner surface of the pump casing has axial thrust generating surfaces which are so shaped as to gradually decrease the first and the second gaps towards the downstream sides as viewed in the direction of flow of fuel introduced into these gaps. In consequence, axial thrust forces are generated by wedging action of the fuel introduced into the gaps so that the impeller is kept out of contact with the inner surfaces of the pump casing during operation of the pump device.

12 Claims, 33 Drawing Figures

ELECTRIC FUEL PUMP DEVICE

This is a continuation of application Ser. No. 405,579, filed Aug. 5, 1982, which was abandoned upon the filing hereof.

BACKGROUND OF THE INVENTION

The present invention relates to an electric fuel pump device for use in pumping a liquid fuel from a fuel reservoir to a fuel consuming equipment. More particuarly, the invention is concerned with an electric fuel pump device for pumping a liquid fuel from a fuel tank to the combustion chamber of an engine of a vehicle.

In general, electronic fuel injecting pump system of vehicle engine incorporates an electric fuel pump which is adapted to pump a liquid fuel from the fuel tank to the combustion chamber of the engine, at a comparatively high pressure of 2 to 3 $Kg/cm^2$. In order to obtain the comparatively high pressure, constant volume type pump is used in the electric fuel pump used for this purpose.

Although some fuel pump devices incorporate centrifugal pumps, the use of such fuel pump devices is limited only to the cases where the discharge pressure is as low as or less than 1 $Kg/cm^2$. The fuel pump apparatus employing a constant volume type pump cannot acquire the desired performance unless it is fabricated at a high precision, so that the production cost is raised and, in addition, the levels of the vibration and noise are inconviniently increased due to a large pulsation of the discharge pressure. To the contrary, the fuel pump device incorporating a centrifugal pump is hardly operative to provide a high discharge pressure at small flow rate, although it is suitable for providing a large flow rate at a comparatively low pressure.

In order to obviate the above-described shortcomings of the prior art, the present inventors have proposed a fuel pump device incorporating a regenerative pump in the pumping section thereof. The regenerative pump, which is referred to also as "Wesco pump" can provide a high discharge pressure without any pulsation at a reduced level of noise. It is possible to easily obtain a high pressure of 2 to 3 $Kg/cm^2$ by using a regenerative pump, particuarly a regenerative pump having an impeller of closed vane type. In the use of the regenerative pump of this type, however, it is necessary to keep suitable distances or clearances between both axial end surfaces of the impeller and the axial inner surfaces of the pump casing, for otherwise the axial end surface may inconveniently contact the opposing axial inner surface of the casing to generate a friction which in turn increases the driving torque to seriously deteriorate the pump performance. The following two ways can be taken as countermeasures for overcoming these problems. The first way is to precisely locate and fix the impeller on the rotor shaft, while the second way is to maintain a balance of pressure between both sides of the impeller while mounting the latter axially movable. These countermeasures, however, require the parts have to be fabricated at a considerably high precision, resulting in a raised cost of production.

SUMMARY OF THE INVENTION

Accordingly, an object of the invention is to provide an electric fuel pump device capable of pumping a liquid fuel at a high discharge pressure without any pulsation and at a reduced level of noise.

Another object of the invention is to provide an electric pump device in which the deterioration in the durability and performance of the pump, as well as generation of noise, attributable to the accidental contact between the inner surface of the casing and the opposing axial end surface of the impeller is eliminated and, at the same time, the production cost is lowered economically.

To these ends, according to an aspect of the invention, there is provided an electric fuel pump device comprising a regenerative pump section and an electric motor section for driving the regenerative pump section, wherein the improvement comprises that the regenerative pump section includes a pump casing having a first inner surface and a second inner surface spaced axially from each other to define therebetween a pump chamber, and an impeller accomodated by the pump chamber and mounted on a rotor shaft for rotation as a unit therewith but axially movably relatively to the rotor shaft, the rotor shaft being adapted to be rotated by the electric motor section, the impeller having a first axial end surface opposing to the first inner surface of the pump casing leaving a first gap therebetween and the other axial end surface opposing to the second inner surface of the pump casing with a second gap left therebetween, each of the first inner surface and the second inner surface of the pump casing having an axial thrust generating surface of such a shape that the gap is gradually decreased towards the downstream side of the fuel introduced into the gap, thereby to prevent the accidental contact between the impeller and the first and second inner surfaces of the pump casing during operation of the pump.

The above and other objects, features and advantages of the invention will become clear from the following description of the preferred embodiments taken in conjunction with the accompanying drawings.

DESCRIPTION OF THE PREFERRED EMBODIMENTS

Figure 1:
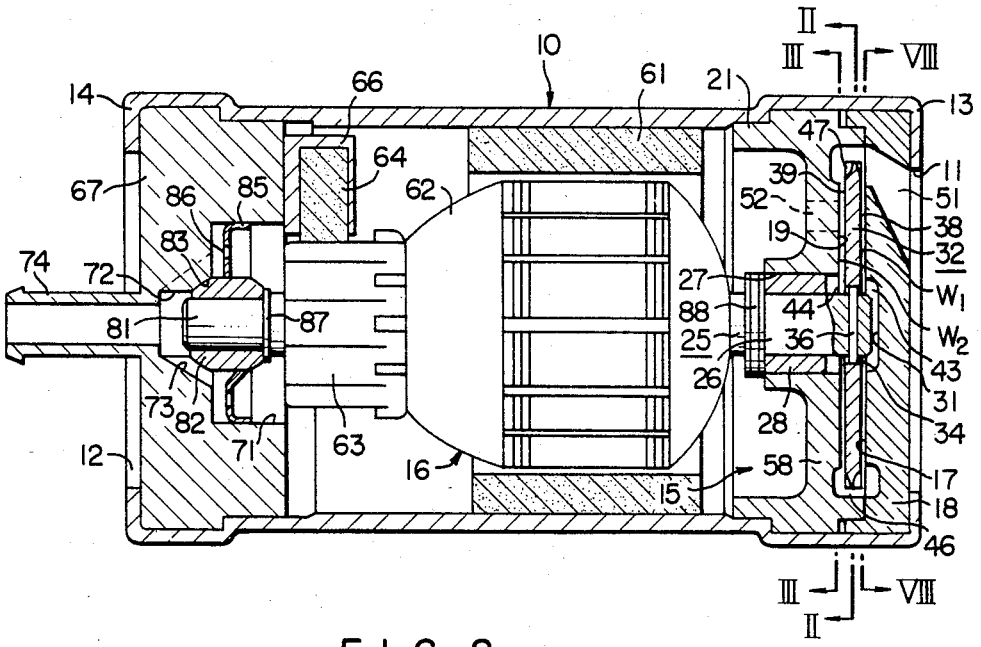
FIG. 1 is a sectional view of an electric fuel pump in accordance with an embodiment of the invention, taken along the axis thereof.
Figure 2:
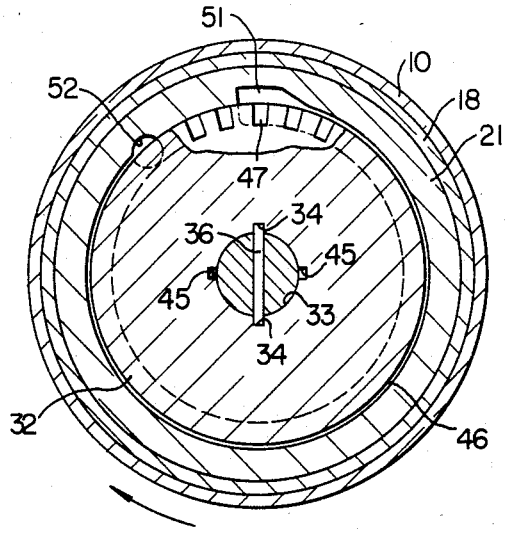
FIG. 2 is a sectional view taken along the line II—II of FIG. 1.

FIGS. 1 thru 8 show an electric fuel pump in accordance with a first embodiment of the invention. This fuel pump device is adapted to be immersed, for example, in a liquid fuel contained by a fuel tank of a vehicle. Referring first to FIG. 1, the pump device has a generally cylindrical housing 10 having two end walls 13 and 14 which are provided with openings 11 and 12, respectively. The pump device is further provided with a regenerative pump section 15 disposed in the housing in contact with one axial end surface of the housing 10, and an electric motor section 16 disposed in the housing 10 to take a position adjacent to the regenerative pump section. The motor section 16 is operatively connected to the pump section 15 to drive the latter. The regenerative pump section 15 has a pump casing which is composed of a first casing part 18 having an inner surface 17 and an outer surface which materially closes the opening 11 in one axial end wall of the housing 10, and a second housing part 21 having an inner surface 19 which cooperates with the inner surface 17 of the first casing part in defining therebetween a pump chamber.

A rotor shaft 25 extends coaxially with the housing 10 and is rotatably supported at its one end 26 by a bearing 28 which is press-fitted into the axial central bore 27 formed in the second casing part 21. The above-mentioned axial end 26 of the shaft 25 extends through the pump chamber and has an axial end surface which is received by a central recess 31 formed in the inner surface 17 of the first casing part 18.

A substantially disk-shaped impeller 32 is mounted on the rotor shaft 25 in such a manner as to be able to rotate within the pump chamber. The impeller 32 is provided with an axial central bore 33 (See FIG. 2) adapted to be fit by the axial end portion 26 of the shaft 25. The wall defining the central bore 33 is provided with a pair of diametrically opposing axial grooves 34. A pin 36 having a circular cross-section extends through the axial end portion 26 of the shaft 25. Both ends of the pin 36 are received by the pair of axial grooves 34. The impeller 32 is mounted on the shaft 25 for rotation as a unit with the latter but axially movably relatively thereto. The impeller 32 has one axial end surface 38 which opposes to the first inner surface of the pump casing, i.e. the inner surface 17 of the first casing part 18, with a first gap $w_1$ left therebetween, and the other axial end surface 39 opposing to a second inner surface of the pump casing, i.e. the inner surface 19 of the second casing part 21, with a second gap $w_2$ left therebetween. Although shown in FIG. 1 in an exaggerated manner, these gaps $w_1$ and $w_2$ are actually very small.

The recess 31 formed in the first casing part 18 defines a chamber 43 in cooperation with the outer peripheral surface and axial end surface of the axial end portion 26 of the rotor shaft 25. The axial central bore 27 formed in the second casing part 21 defined a chamber 44 in cooperation with the axial end surface of the bearing 28 and the outer peripheral surface of the axial end portion 26 of the shaft 25. As clearly shown in FIG. 2, the wall surface of the axial central bore 33 provided in the impeller 32 is provided with a second pair of axial grooves 45 opposing diametrically to each other. The chambers 43 and 44 are communicated with each other through the second pair of axial grooves 45 thereby to keep balance of pressure between the chambers 43 and 44.

The impeller 32 has an outer peripheral portion which defines a substantially annular passage 46 in the pump casing parts 18 and 21. A plurality of radial vane grooves 47 are formed in the outer peripheral portion of the impeller at both axial end surfaces 38 and 39 of the latter at an equal circumferential pitch. In the illustrated impeller, the bottom surfaces of the vane grooves 47 formed in one axial end surface 38 do not intersect the other axial end surface 39 of the impeller. Similarly, the bottom surfaces of the vane grooves 47 formed in the other axial end surface 39 do not intersect the one axial end surface 38 of the impeller. Thus, the illustrated embodiment is a socalled closed vane type impeller.

The pump passage 46 is communicated with a liquid fuel in a fuel reservoir (not shown) through a suction port 51 formed in the first casing part 18 and also with a space in the housing 10 through a discharge port 52 formed in the second casing part 21.

The electric motor section 16 has a couple of semi-cylindrical permanent magnets 61 disposed in the housing 10 concentrically with the rotor shaft 25, an armature fixedly mounted on the rotor shaft 25 concentrically with the permanent magnets 61, and a commutator 63 connected to the armature 62 and fixed to the rotor shaft 25. Brushes 64 are held in sliding contact with the commutator 63. Brushes 64 are held by brush holders 66 fixed to an end block 67 which is disposed in the housing in such a manner as to materially close the opening 12 formed in the other axial end wall 14 of the housing 10. The end block 67 has a central recess 71 formed in one axial end surface facing the space in the housing 10 and a second recess 72 formed in the bottom of the central recess 71. A plurality of circumferentially spaced grooves 73 are formed in the wall of the second recess 72. Each groove 73 is provided with a tapered bottom surface. The end block 67 is provided with a hollow projection 74 projecting outwardly from the other axial end surface thereof. The space in the hollow projection 74 is communicated with the second recess 72. The hollow projection 74 is connected to fuel consuming equipment such as an engine which is not shown.

The shaft 25 is rotatably supported at its other end 81 by a bearing 82 which is seated on a chambered seat 83 in the recess 72 and is held at the predetermined position by an annular retainer 85 disposed in the central recess 71. The retainer 85 is provided with a plurality of circumferentially spaced holes 86.

The shaft 25 is adapted to be held at a predetermined axial position by a spacer 87 which is mounted on the shaft 25 in contact with one axial end surface of the bearing 82 and by a spacer 88 which is mounted on the shaft 25 in contact with one axial end surface of the bearing 28.

The electric fuel pump device having the described construction operates in a manner explained hereinunder. As electric power is supplied from a power source (not shown) through the brushes 64, the armature 62 starts to rotate and the rotation of the armature 62 is transmitted to the impeller 32 through the shaft 25, so that the impeller 32 rotates in the clockwise direction as indicated by an arrow in FIG. 2. In consequence, the liquid fuel is sucked from the fuel reservoir into the pump passage 46 through the suction port 51. The fuel thus sucked is boosted by the vane grooves 47 of the impeller 32 as it flows along the pump passage 46 and is discharged into the space in the housing 10 through the discharge port 52, and is sent to the fuel consuming equipment through the annular gap between the permanent magnet 61 and the armature 62, holes 86 formed in the retainer 85, grooves 73 formed in the end block 67 and the bore in the hollow projection 74.

Figure 10:
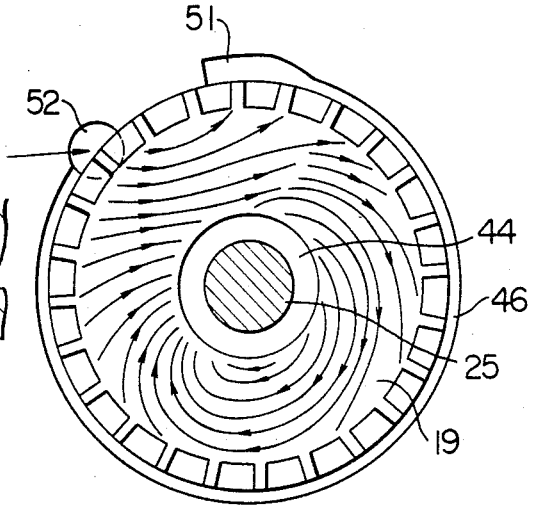
FIG. 10 is an illustration of the state of flow of fuel introduced into the second gap.

During the operation of the pump, a flow of fuel is formed as shown in FIG. 10, in the second gap $w_2$ formed between the other axial end surface 39 of the impeller 32 and the second inner surface 19 of the pump casing. On the other hand, a flow of fuel is generated in the first gap $w_1$ between one axial end surface 38 of the impeller 32 and the first inner surface 17 of the pump casing, in symmetry to the first-mentioned flow of fuel shown in FIG. 10 respect to a plane which is perpendicular to the axis of the rotor shaft 25. Namely, when a pumping action is made by the rotation of the impeller 32, the pressure of the fuel in the pump passage 46 is successively increased substantially linearly from the suction side to the discharge side. Meanwhile, fuel is introduced into the portions 43, 44 of the pump chamber surrounding the shaft 25 from the pump passage 46 through the first and second gaps $w_1$ and $w_2$ and the pressure in the chamber portions 43, 44 is increased up to 40 to 45% of the discharge pressure. The flow of fuel in the first and second gaps $w_1$ and $w_2$ is influenced by the pressure differential between the pump passage 46 and the chambers 43, 44. More specifically, in the upstream half part of the pump passage 46 extending between the suction port 51 and the discharge port 52, a radial flow of fuel is generated to flow from the chambers 43, 44 to the pump passage 46, whereas, in the downstream half part of the pump passage 46, a flow of fuel is generated to flow from the pump passage 46 to the chambers 43, 44. In addition, since the impeller 32 is rotating, circumferential flow of fuel is generated in each of the first and second gaps $w_1$ and $w_2$ accompanying the surfaces of the impeller 32 because of the viscosity of the fuel. Thus, in each gap, the flow of fuel is formed as a vector sum of the radial flow component and the circumferential flow component. In consequence, a flow of fuel as indicated by arrow in FIG. 10 is formed in the second gap $w_2$, whereas the flow of fuel is generated in the first gap $w_1$ in symmetry to that shown in FIG. 10 with respect to a plane perpendicular to the axis of the shaft 25.

Figure 8:
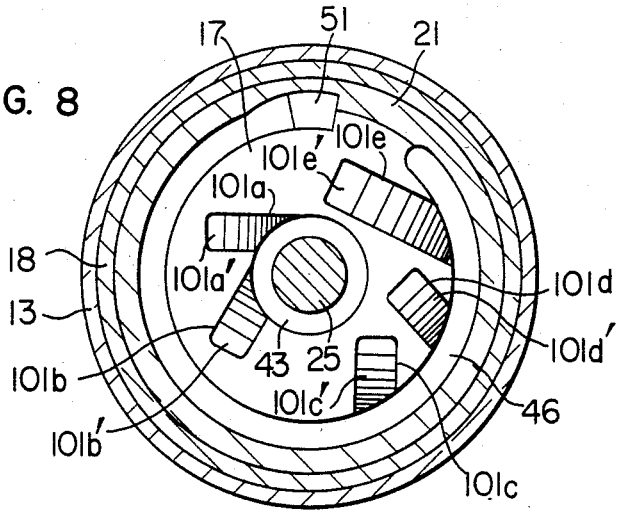
FIG. 8 is a view of the fuel pump device shown in FIG. 1 as viewed in the direction of the arrows VIII—VIII showing particularly a thrust generating surface formed on the first inner surface of the pump casing.

FIG. 8 shows the result of an experiment conducted by the present inventors. This experiment was conducted with a model of the pump device having a regenerative pump section which is enlarged to a size 8 times as large as that of the actual one and having a pump casing made of a transparent acrylic resin to permit the inspection of the inner side. The pump was constructed such that the Reynolds number and the flow direction in the first and second gaps are identical to those in the actual regenerative pump section to create a flow in each gap similar to that obtained in the actual gap. The pump casing used in this experiment was devoid of a later-mentioned thrust generating surface.

As stated before, in order to obtain a higher performance of the fuel pump device, it is desirable to maintain the first and second gaps $w_1$ and $w_2$ substantially equal to each other to minimize the chance of contact between the end surfaces 38, 39 of the impeller 32 and the inner surfaces 17, 19 of the pump casing, during rotation of the impeller 32. To this end, the fuel pump device of the invention employs an arrangement which acts to hold the impeller 32 substantially at the mid position between the inner surfaces 17 and 19 of the pump casing and, when the impeller is moved axially towards the inner surface 17 or 19 of the pump casing, to push back the impeller 32 in the opposite direction.

Figure 4:
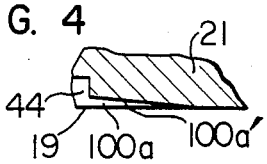
FIG. 4 is a sectional view taken along the line IV—IV of FIG. 3.
Figure 5:
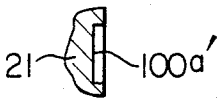
FIG. 5 is a sectional view taken along the line V—V of FIG. 3.
Figure 6:
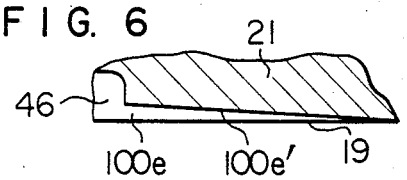
FIG. 6 is a sectional view taken along the line VI—VI of FIG. 3.

Namely, as shown in FIGS. 3 thru 7, the fuel pump device of the first embodiment has five recesses **100*a* to 100*e* having tapered bottom surfaces, i.e. thrust generating surfaces 100*a*' to 100*e*', formed in the second inner surface of the pump casing, i.e. in the inner surface 19 of the second casing part 21. As shown in FIG. 6, a plurality of recesses 101*a* to 101*e* having similar thrust generating surfaces 101*a*' to 101*e*' are formed in the first inner surface of the pump casing, i.e. in the inner surface of the first casing part 18**.

Figure 3:
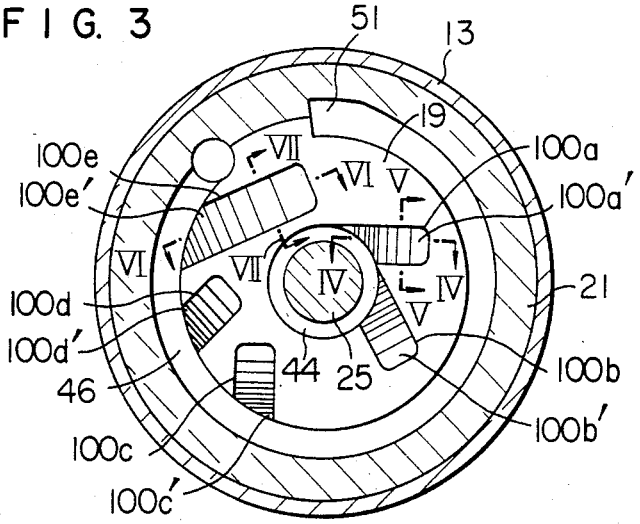
FIG. 3 is a view of the fuel pump device shown in FIG. 1 as viewed in the direction of arrows III—III, showing particularly the thrust generating surface formed on the second inner surface of the pump casing.

As will be understood from a comparison between the arrangements shown in FIGS. 3 and 10, the bottom surfaces of the recesses **100*a* to 100*e* formed in the inner surface 19 of the second casing part 21, i.e. the thrust generating surfaces 100*a*' to 100*e*', extend in the direction of flow of the fuel in the second gap $w_2$. The recess 100*a* and the thrust generating surface 100*a*' of the same have cross-sectional configurations as shown in FIGS. 4 and 5. The recess 100*b* and its thrust generating surface 100*b*' have similar cross-sections. These recesses 100*a* and 100*b* open at their innermost portions to the chamber 44 constituting the part of the pump chamber surrounding the rotor shaft 25. The thrust generating surfaces 100***a'*, 100*b'* of these recesses are inclined in such a manner as to gradually decrease the depth of the recesses 100*a*, 100*b* from the portions communicating with the chamber 44 along the length of these recesses 100*a*, 100*b* thereby to gradually decrease the second gap $w_2$ towards the downstream side as viewed in the direction of flow of fuel.

Figure 7:
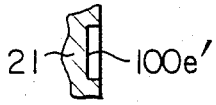
FIG. 7 is a sectional view taken along the line VII—VII of FIG. 3.

The recess 100*e* and the thrust generating surface 100*e'* have shapes as shown in FIGS. 6 and 7, as well as the recesses 100*c*, 100*d* and their thrust generating surfaces 100*c'*, 100*d'*. Namely, these recesses 100*c* to 100*e* communicate with the pump passage 46 at their innermost portions, and the thrust generating surfaces 100*c'* to 100*e'* of these recesses are so inclined as to gradually decrease the depth of the recesses 100*c* to 100*e* from the portions communicating with the pump passage 46 along the length of these recesses thereby to gradually decrease the second gap $w_2$ gradually towards the downstream side as viewed in the direction of flow of the fuel.

The recesses 101*a* to 101*e* formed in the inner surface 17 of the first casing part are similar to the recesses 100*a* to 100*e* formed in the inner surface 19 of the second casing part 21. The recesses 101*a* to 101*e* are formed in symmetry to the recesses 100*a* to 100*e* with respect to the plane perpendicular to the axis of the shaft 25. The thrust generating surfaces 101*a'* to 101*e'* of the recesses 101*a* to 101*e* extend in the direction of flow of the fuel in the first gap $w_1$. The innermost portions of the recesses 101*a*, 101*b* open to the chamber 43 constituting the portion of the pump chamber surrounding the shaft 25, and the innermost portions 101*c*, 101*d*, 101*e* open to the pump passage 46. The thrust generating surfaces 101*a'* to 101*e'* of these recesses 101*a* to 101*e* are so inclined as to gradually decrease the first gap $w_1$ towards the downstream side as viewed in the direction of flow of the fuel.

In FIGS. 3 and 8, a number of laterally extending lines in recesses are the lines of equal depth.

Thanks to the provision of the thrust generating surfaces 100*a'* to 100*e'* and 101*a'* to 101*e'*, axial thrust forces act on the impeller 32 due to a wedging action which will be detailed later, so that the impeller 32 can be maintained substantially at the mid point between the inner surface 17 of the first casing part 18 and the inner surface 19 of the second casing part 21.

Figure 9A:
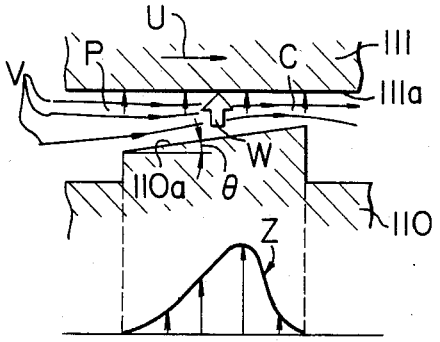
FIGS. 9A to 9C are illustrations of wedging effect.

The wedging action mentioned before will be explained with specific reference to FIGS. 9A to 9C. Referring first to FIG. 9A, a stationary wall 110 has an inclined surface 110*a* which oposes to a horizontal surface 111*a* of a movable wall 111 with a small gap C. Then, as the horizontal surface 111*a* is moved in the direction of the arrow U, a flow of fluid is generated in the gap C to flow from the wider side to the narrower side as indicated by an arrow V. This flow of fluid acts just like as a wedge driven into the gap C to produce a so-called wedging effect to generate a load W which acts on the horizontal surface 111*a* to move the same away from the inclined surface 110*a*. A curve Z shows the distribution of the pressure P acting on the horizontal surface 110*a*.

The load W is increased as the horizontal surface 111*a* gets closer to the inclined surface 110*a*, i.e. as the gap C is decreased. The wedging action is produced to apply a load W on the horizontal surface 111*a*, even when the horizontal surface 111*a* is stationed without being moved in the direction of the arrow U, provided that the flow of fluid as indicated by the arrow V is produced.

The relationship between the thrust generating surfaces 100*a'* to 100*e'* and the opposing end surface 39 of the impeller 32 a shown in FIGS. 3 thru 6 is similar to the relationship shown in FIG. 9A between the inclined surface 110*a* and the horizontal surface 111*a*.

Figure 9B:
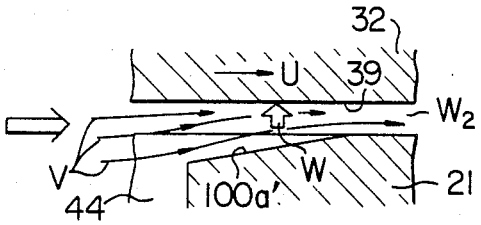
Figure 9C:
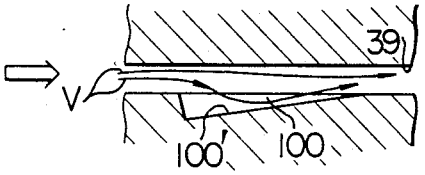

FIG. 9B schematically shows the relationship between one 100*a'* of the thrust generating surfaces and the end surface 39 of the impeller 32. Namely, referring to FIG. 9B, the impeller 32 rotates in the direction of the arrow U, while the fuel flows in the second gap $w_2$ from the wider side to the narrower side of the second gap $w_2$ as indicated by an arrow V. Therefore, a load W is applied to the end surface 39 of the impeller 32 to move the same away from the thrust generating surface 100*a*. FIG. 9B illustrates only the relationship between the thrust generating surface 100*a'* and the end surface 39 of the impeller 32, but the same relationship applied also to that between the thrust generating surfaces 100*b'* to 100*e'* and the end surface 39, as well as to that between the thrust generating surfaces 101*a'* to 101*e'* and the end surface 38 of the impeller 32.

As stated before, the innermost portion of the recess 100*a* in the first embodiment opens to the chamber 44. This, however, is not exclusive and it is possible to adopt a recess 100 shown in FIG. 9C, insteadly of opening the same to the chamber 44. However, in the case where the recess 100 as shown in FIG. 9C is used, there is a fear that the fuel does not smoothly flow along the thrust generating surface 100' of the recess 100 to fail to apply sufficient load to the end surface 9. In contrast to the above, by making the innermost portion of the recess 100*a* open to the chamber 44 as in the first embodiment, it is possible to smoothly introduce the fuel into the second gap $w_2$ along the thrust generating surface 100*a'* of the recess 100*a* as shown in FIG. 9B, so that a sufficiently large wedging effect is produced to apply a sufficiently large load W to the end surface 39 of the impeller 32. For the same reason as above, the innermost portion of the recess 100*b* and the innermost portions of the recesses 100*c* to 100*e* in the first embodiment open to the chamber 44 and the pump passage 46, respectively. Meanwhile, the innermost portions of the recesses 101*a*, 101*b* and the innermost portions of the recesses 101*c* to 101*e* are made to open to the chamber 43 and the pump passage 46, respectively.

As will be clearly seen from the foregoing description, thanks to the provision of the thrust generating surfaces 101*a'* to 101*e'* and 100*a'* to 100*e'* on the inner surfaces 17 and 19 of the pump casing, the impeller 32 is urged during operation of the pump device to the left as viewed in FIG. 1 by the fuel introduced into the first gap $w_1$ and to the right as viewed in FIG. 1 by the fuel introduced into the second gap $w_2$ respectively. Assuming here that the impeller 32 is urged to the left as viewed in FIG. 1 by an external force to increase the first gap $w_1$ while decreasing the second gap $w_2$, the pressure for urging the impeller to the left by the wedging effect of the fuel introduced into the first gap $w_1$ is decreased while the rightward pressing force caused by the wedging effect of the fuel introduced into the second gap $w_2$ is increased. Therefore, the impeller 32 is pushed back rightwardly to the position where the first and second gaps $w_1$ and $w_2$ are substantially equal to each other. Similarly, the impeller is forced back to the above-mentioned position to substantially equalize the first and second gaps $w_1$ and $w_2$ when the impeller 32 is happened to be moved to the right by an external force. Thus, the impeller 32 is held substantially at the mid point between the first inner surface 17 and the second inner surface 19 of the pump casing to remarkably reduce the chance of contact between the impeller and both inner surfaces 17, 19 of the pump casing.

Figure 11:
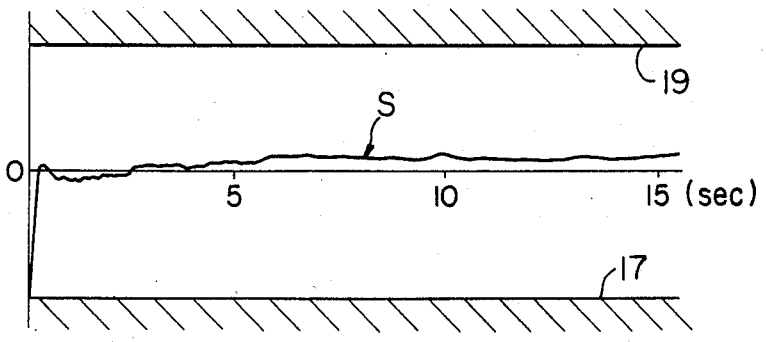
FIG. 11 is an illustration of the behaviour of the impeller in the operating state of the fuel pump device.

FIG. 11 shows the behaviour of the impeller 32 of the fuel pump device of the first embodiment in relation to time. As shown by a line S, the impeller 32 is moved to the substantially mid point between the inner surfaces 17 and 19 of the pump casing soon after the fuel pump device is started and held substantially at a position near the above-mentioned mid point during the operation of the pump device. Therefore, the undesirable contact between the impeller 32 and the inner surfaces 17, 19 of the pump casing is avoided perfectly.

Figure 12:
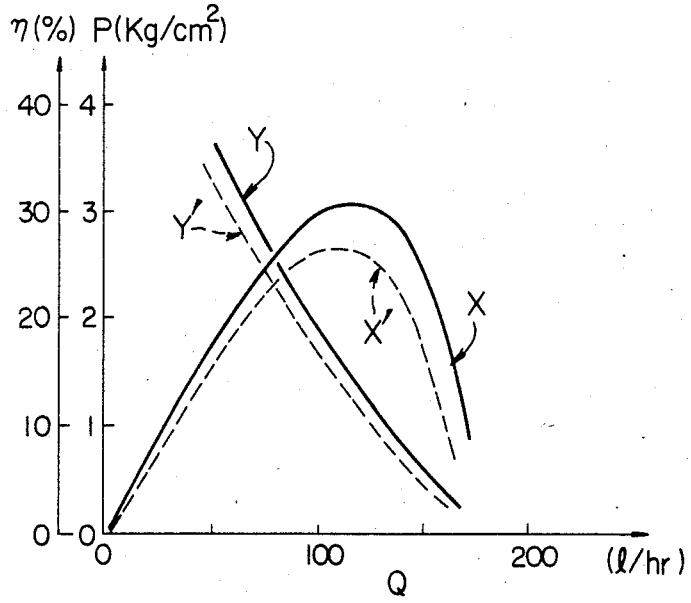
FIG. 12 is an illustration of the performance of the fuel pump device in comparison with the device having no thrust generating surface.
Figure 13:
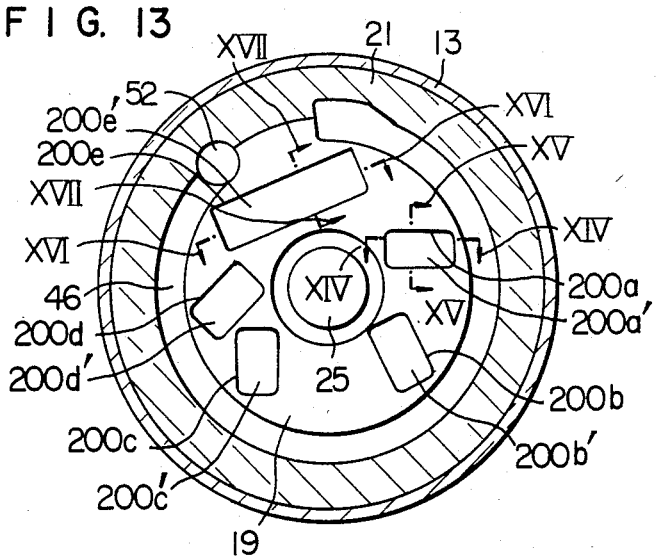
FIG. 13 is a view similar to that in FIG. 3 showing a thrust generating surface provided in the fuel pump device in accordance with a second embodiment of the invention.
Figure 14:
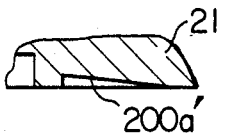
FIG. 14 is a sectional view taken along the line XIV—XIV of FIG. 13.
Figure 15:
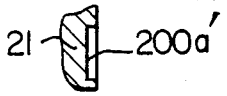
FIG. 15 is a sectional view taken along the line XV—XV of FIG. 13.
Figure 16:
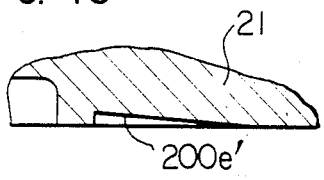
FIG. 16 is a sectional view taken along the line XVI—XVI of FIG. 13.
Figure 17:
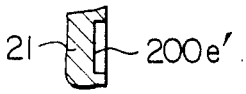
FIG. 17 is a sectional view taken along the line XVII—XVII of FIG. 13.

FIG. 12 shows the result of an experiment conducted to compare the performance of the fuel pump device of the first embodiment having the above-mentioned recess 101*a* to 101*e* and the recesses 100*a* to 100*e* formed in the inner surfaces 17 and 19 of the pump casing with the performance of a fuel pump device having no recesses. More specifically, in FIG. 12, full-line curves X and Y represent the efficiency % and the discharge pressure P ($Kg/cm^2$) in relation to the discharge rate as observed in the fuel pump device of the first embodiment, while broken line curves X' and Y' show the efficiency and dischage pressure in relation to the discharge rate as observed in the fuel pump device having no recess. From this Figure, it will be seen that the discharge pressure and the efficiency are considerably increased to improve the performance of the fuel pump device remarkably, by the provision of the recesses 101*a* thru 101*e* and 100*a* thru 100*e* in the inner surfaces 17 and 19 of the pump casing.

A second to fifth embodiments of the invention, employing different shapes and numbers of the thrust generating surfaces 100*a'* to 100*e'* and 101*a'* to 101*e'* will be explained hereinafter with reference to FIGS. 13 thru 29. In the first embodiment described hereinbefore, the thrust generating surfaces 101*a'* to 101*e'* formed in the first inner surface of the pump casing, i.e. in the inner surface 17, are positioned in symmetry to the thrust generating surfaces 100*a'* to 100*e'* formed in the second inner surface 19 with respect to the plane perpendicular to the axis of the shaft 25. Also, the shapes of the thrust generating surfaces formed in the inner surface 17 and the thrust generating surfaces formed in the inner surface 19 are in symmetry with respect to the above-mentioned plane. This symmetrical arrangement applied also to the second to fifth embodiments. Therefore, in the following description of the second to fifth embodiments of the invention, the explanation will be made only to the thrust generating surface formed in the second inner surface of the pump casing, while the explanation of the thrust generating surface in the first inner surface 17 is omitted.

FIGS. 13 thru 17 show a second embodiment of the invention in which recesses 200*a* to 200*e* having respective thrust generating surfaces 200*a'* to 200*e'* are formed in the inner surface 19 of the pump casing. These recesses 200*a* to 200*e* resemble the recesses 100*a* to 100*e* of the first embodiment but are different from those in the first embodiment in that the recesses 200*a* and 200*b* do not open at their innermost portions to the chamber 44 and that the innermost portions of the recesses 200*c* to 200*e* do not open to the pump passage 46. Although the advantages of the invention are achieved by the arrangement of the second embodidment, the first embodiment is preferred to the second one for the reasons stated before in connection with FIGS. 9B and 9C.

Figure 18:
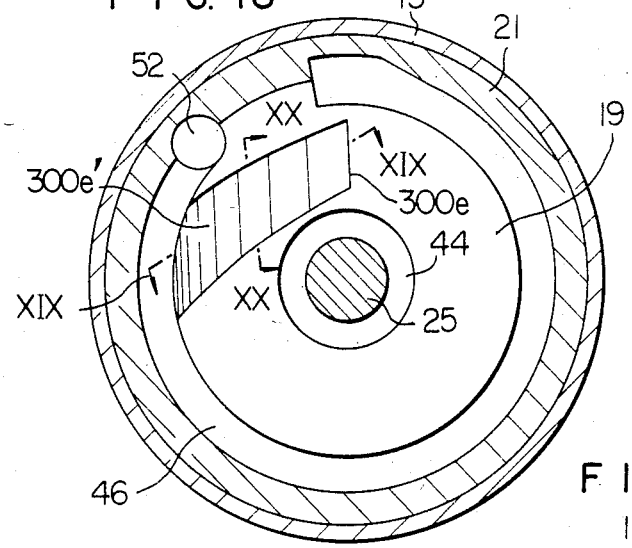
FIG. 18 is a view similar to that in FIG. 3, showing the thrust generating surface in a fuel pump device constructed in accordance with a third embodiment of the invention.
Figure 19:
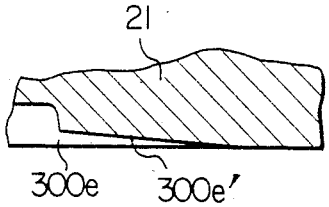
FIG. 19 is a sectional view taken along the line XIX—XIX of FIG. 18.
Figure 20:
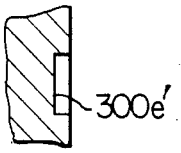
FIG. 20 is a sectional view taken along the line XX—XX of FIG. 18.
Figure 21:
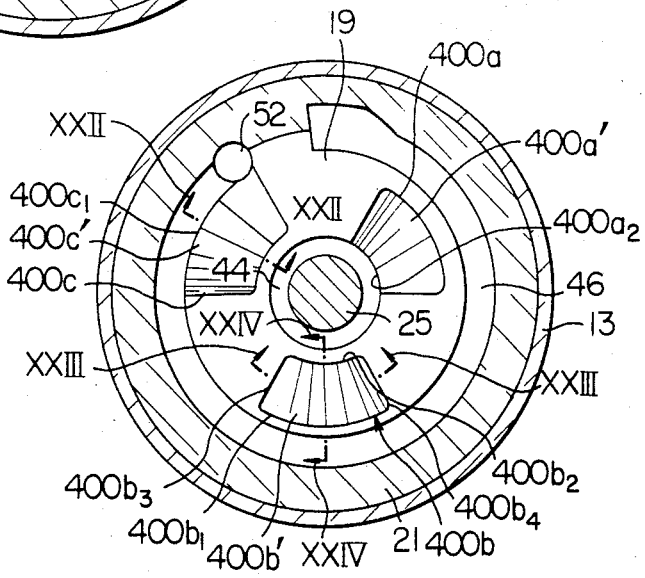
FIG. 21 is a view similar to that in FIG. 3, showing the thrust generating surface in a fuel pump device in accordance with a fourth embodiment of the invention.
Figure 22:
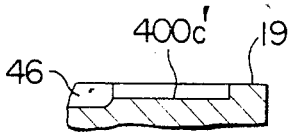
FIG. 22 is a sectional view taken along the line XXII—XXII of FIG. 21.
Figure 23:
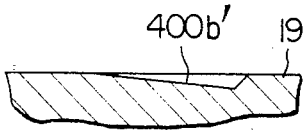
FIG. 23 is a sectional view taken along the line XXIII—XXIII of FIG. 21.
Figure 24:
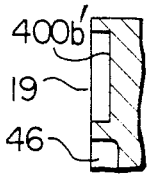
FIG. 24 is a sectional view taken along the line XXIV—XXIV of FIG. 21.

FIGS. 18 to 20 show a third embodiment of the invention in which a single recess 300*e* having a thrust generating surface 300*e'* is formed in the inner surface 19 of the pump casing. The recess 300*e* resembles the recess 100*e* of the first embodiment but has greater width and length than the latter. In addition, the recess 300*e* extends in the longitudinal direction at such a slight curvature as to project outwardly. The recess 300*e* opens at its innermost portion to the pump passage 46. The thrust generating surface 300*e'* extends at such an inclination that the depth of the recess 300*e* is gradually decreased from the position of the pump passage 46 along the length of the recess 300*e* which extends at a curvature. In FIG. 18, a multiplicity of lines extending across the recess 300*e* are the lines of equal depth. In the third embodiment also, the thrust generating surface 300*e'* gradually decreases the gap $w_2$ towards the downsream side as viewed in the direction of flow of the fuel introduced into the second gap $w_2$, so that an axial thrust force is applied to the impeller by the wedging effect explained before. In addition, since the recess 300*e* and the thrust generating surface 300*e'* have substantial size, the weding effect will be never suppressed largely even if the state of flow of fuel is changed in the second gap.

FIGS. 21 thru 24 show a fourth embodiment of the invention in which three recesses 400*a* to 400*c* having respective thrust generating surfaces 400*a'* to 400*c'* are formed at a constant circumferential pitch in the inner surface 19 of the pump casing. As will be clearly understood from FIG. 21, the recess 400*b* as viewed from the upper side of the inner surface 19 of the pump casing has such a shape as being composed of a radially outer edge portion $400b_1$ extending in an arcuate form along the pump passage 6 and the radially inner edge $400b_2$ extending in an arcuate form adjacent to the chamber 44, both edges being connected at their both ends to each other by two edge portions $400b_3$ and $400b_4$ extending radially through the axis of the shaft 25. The thrust generating surface 400*b'* is so inclined as to gradually decrease the depth of the recess in the clockwise direction as viewed in FIG. 21 and FIG. 23.

The shapes of the recesses 400*a*, 400*c* and their thrust generating surfaces 400*a'*, 400*c'* are substantially identical to those of the recess 400*b* and the thrust generating surface 400*b'* explained above. However, in order to permit a smooth introduction of the fuel into the recesses 400*a* and 400*c*, the radially inner edge $400a_2$ of the recess 400*a* and the radially outer edge $400c_1$ of the recess 400*c* are opened to the chamber 44 and the pump passage 46, respectively. Radial thin lines extending through the recesses 400*a*, 400*b* and 400*c* represent lines of equal depth.

In this fourth embodiment also, the second gap is graudally decreased towards the downstream side as viewed in the direction of the flow of fuel introduced thereinto, by the thrust generating surfaces 400*a'* to 400*c'*, so that axial thrust forces are applied to the impeller by the wedging effect explained before. In addition, since the recesses 400*a* and 400*c* extend in the circumferential direction with a considerably large breadth in the radial direction, the wedging effect is never influenced adversely even when the state of flow of fuel is changed in the second gap $w_2$.

In the first to fourth embodiments described hereinbefore, the thrust generating surface is constituted by the bottom surface of each recess formed in the inner surface of the pump casing. This, however, is not exclusive and the thrust generating surface may be constituted by the top surface of a ridge formed on the inner surface of the pump casing.

Figure 25:
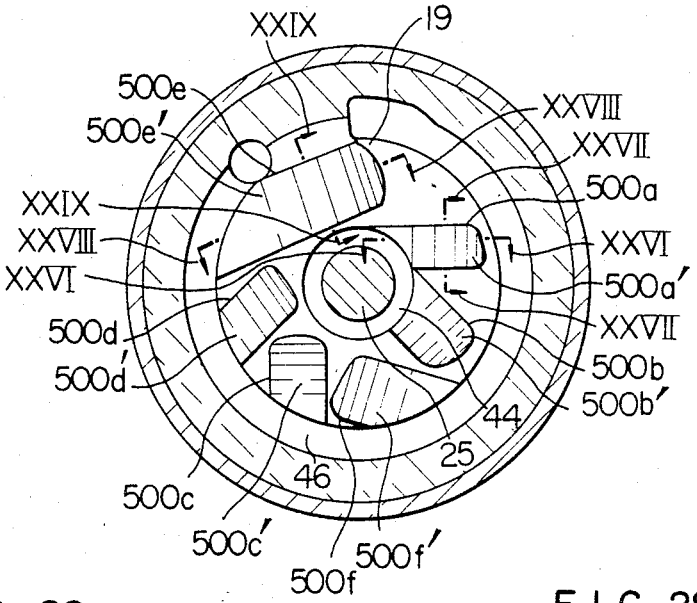
FIG. 25 is a view similar to that in FIG. 3, showing the thrust generating surface in a fuel pump device in accordance with a fifth embodiment of the invention.
Figure 26:
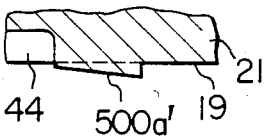
FIG. 26 is a sectional view taken along the line XXVI—XXVI of FIG. 25.
Figure 27:
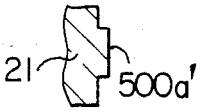
FIG. 27 is a sectional view taken along the line XXVII—XXVII of FIG. 25.
Figure 28:
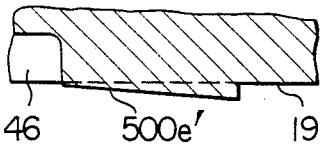
FIG. 28 is a sectional view taken along the line XXVIII—XXVIII of FIG. 25.
Figure 29:
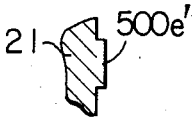
FIG. 29 is a sectional view taken along the line XXIX—XXIX of FIG. 25.

FIGS. 25 thru 29 show a fifth embodiment of the invention in which ridges 500*a* and 500*b* and ridges 500*c* to 500*f* are formed on the inner surface 19 of the pump casing. The ridges 500*a* and 500*b* are so shaped that their height is gradually increased along their length from the portion facing the chamber 44, while the ridges 500*c* to 500*f* are so shaped that their height is gradually increased along their lengths from the portion facing the pump passage 46. The top surfaces of the ridges constitute the thrust generating surfaces 500*a'* to 500*f'*. As in the case of the first to fourth embodiments described before, the thrust generating surfaces 500*a'* to 500*f'* are so inclined as to gradually decrease the second gap $w_2$ (See FIG. 1) towards the downstream side as viewed in the direction of flow of fuel introduced into the second gap. The thrust generating surfaces 500*a'* and 500*b'* join to the wall surface of the chamber 44 at positions where the ridges 500*a* and 500*b* take the minimum height. On the other hand, the thrust generating surfaces 500*c'* to 500*f'* join the wall surface of the pump passage 46 at positions where the ridges 500*c* to 500*f* take the minimum height. In FIG. 25, thin lines described on the ridges 500*a* to 500*f* are the lines of equal height.

Figure 30A:
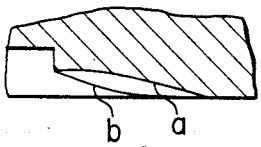
FIGS. 30A and 30B are sectional views showing modifications of the thrust generating surface.
Figure 30B:
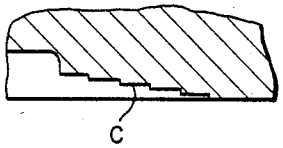

The thrust generating surfaces in the first and second embodiments are inclined linearly. The thrust generating surfaces in the third and fourth embodiments are also inclined linearly as viewed in sections shown in FIGS. 19 and 23. It is possible, however, to make the thrust generating surfaces have convexed or concaved inclined surfaces as shown by (a) and (b) of FIG. 30A or a stepped surface as (c) in FIG. 30B. The same applies also to the fifth embodiment.

It is possible to produce the wedging effect while diminishing the leak from the pump passage by circumferentially forming the concavities or convexities having thrust generating surfaces in a manner like a labyrinth.

As will be understood from the foregoing description, in the electric fuel pump device of the invention, the pulsation of the discharge pressure is eliminated and the generation of noise is suppressed, while achieving a high discharge pressure required by fuel injection type engines, thanks to the use of the regenerative pump in the pump section thereof. In addition, since thrust generating surfaces are formed on the first and second inner surfaces of the pump casing in such a manner as to gradually decrease the first and second gaps towards the downstream side as viewed in the direction of flow of the fuel, axial thrust forces are applied to the impeller due to the wedging effect to always maintain the impeller substantially at the mid point between the first and the second inner surfaces and to force back the impeller to the substantially mid point even when the impeller is happened to be moved towards either one of these inner surfaces. In consequence, the generation of noise due to the accidental contact between the impeller and the inner surface of the pump casing is suppressed while avoiding any deterioration in the durability and the performance of the pump device. In the event that the impeller operates at a position offset from the above-mentioned mid point, i.e. when the impeller is moved towards either one of the inner surfaces of the pump casing, the performance of the pump will be seriously deteriorated even if the impeller does not mechanically contact the inner surface. For instance, about 3 to 5% reduction of pump efficiency is inevitable by the deviation of the impeller from the mid point. It is remarkable that the fuel pump apparatus of the invention is free from this problem and can operate always at a high performance because the impeller deviated from the mid position is automatically and promptly forced back to the mid position as fully explained in this specification.

What is claimed is:

1. An electric fuel pump having a regenerative pump section and an electric motor section for driving said regenerative pump section, wherein said regenerative pump section includes:

a pump casing having a suction and a discharge port;

a first inner surface and a second inner surface which are opposing to each other and spaced axially from each other to form therebetween a pump chamber;

a substantially annular pump passage surrounding said first and second inner surfaces and connected at its ends with said suction and discharge ports, respectively; and an impeller accommodated by said pump chamber and mounted on a rotor shaft for rotation as unit therewith but axially movably relatively thereto, said impeller having one axial end surface opposing to said first inner surface of said pump casing with a first gap left therebetween and another axial end surface opposing to said second inner surface of said pump casing with a second gap left therebetween, said first inner surface and said second inner surface of said pump casing being provided with at least one axial thrust force generating surface which is so shaped as to gradually decrease said first gap and said second gap towards the downstream sides as viewed in a direction of flow of fuel introduced into said gaps, respectively, one end of said axial thrust force generating sufface terminating at said pump passage adjacent to said discharge port, so that the fuel may flow from said pump passage in a direction to said suction port along said axial thrust force generating surface thereby to minimize the chance of contact between said impeller and said first inner surface and a said second inner surface of said pump casing during a running of said impeller.

2. An electric fuel pump device according to claim 1, wherein said thrust generating surface is constituted by a bottom surface of at least one recess formed in each of said first inner surface and said second inner surface of said pump casing, said recesses being so shaped as to gradually decrease a depth of said first gap and said second gap towards the downstream sides as viewed in the direction of flow of fuel introduced into said gaps.

3. An electric fuel pump device according to claim 1, wherein said thrust generating surface is constituted by the top surface of at least one ridge formed on each of said first and second inner surfaces of said pump casing, said ridges being so shaped that the height thereof is gradually decreased towards the downstream sides as viewed in the direction of flow of fuel introduced into said gaps.

4. An electric fuel pump device according to claim 2, wherein each of said first and second inner surfaces of said pump casing has a plurality of recesses to form respective axial thrust force generating surfaces.

5. An electric fuel pump device according to claim 3, wherein each of said first and second inner surfaces of said pump casing has a plurality of ridges to form respective axial thrust force generating surfaces.

6. An electric fuel pump device according to claim 4, wherein the recess adjacent to said suction port opens at its innermost portion to a portion of said pump chamber surrounding said rotor shaft.

7. An electric fuel pump according to claim 4, wherein each of said recesses formed in each of said first and second inner surfaces of said pump casing has such a form when viewed on the plane of said inner surface as having a radially outer edge extending in an arcuate form adjacent to a pump passage surrounding said impeller, a radially inner edge extending in an arcuate form adjacent to the portion of said pump chamber surrounding said rotor shaft, and two radial edges interconnecting both ends of said radially inner edge and said radially outer edge, and wherein each of said recesses is so shaped that the depth thereof is gradually decreased in the direction of rotation of said impeller.

8. An electric fuel pump according to claim 7, wherein the plurality of recesses formed in each of said first and second inner surfaces of said pump casing include at least one of a recess which opens at said radially outer edge to said pump passage and a recess which opens at said radially inner edge thereof to said portion of said pump chamber.

9. An electric fuel pump according to claim 2, wherein each of said first inner surface and said second inner surface of said pump casing has a single recess, and said thrust generating surface constituted by the bottom surface of each recess has a substantial width and extends over a substantial length towards the downstream side as viewed in the direction of flow of fuel introduced into each gap.

10. An electric fuel pump device as claimed in any one of claims 1 to 9, wherein said impeller of said regenerative pump section is a closed vane type impeller.

11. An electric fuel pump device as claimed in claim 4, wherein the axial thrust force generating surface adjacent to said discharge port has a larger length than the other axial thrust force generating surfaces.

12. An electric fuel pump device as claimed in claim 5, wherein the axial thrust force generating surface adjacent to said discharge port has a larger length than the other axial thrust force generating surfaces.

* * * * *